US008919164B2

(12) United States Patent
Shulkin et al.

(10) Patent No.: US 8,919,164 B2
(45) Date of Patent: Dec. 30, 2014

(54) SELF-COMPENSATING RETRACTABLE INSERT FOR HIGH-TEMPERATURE FORMING TOOLS

(75) Inventors: Boris Shulkin, West Bloomfield, MI (US); William A. Kokosza, Windsor (CA); Maximilian Amtmann, Brampton (CA); Aldo Van Gelder, Newmarket (CA)

(73) Assignee: Magna International Inc., Aurora (CA)

( * ) Notice: Subject to any disclaimer, the term of this patent is extended or adjusted under 35 U.S.C. 154(b) by 0 days.

(21) Appl. No.: 14/239,508

(22) PCT Filed: Aug. 17, 2012

(86) PCT No.: PCT/CA2012/000774
§ 371 (c)(1),
(2), (4) Date: Feb. 18, 2014

(87) PCT Pub. No.: WO2013/026138
PCT Pub. Date: Feb. 28, 2013

(65) Prior Publication Data

US 2014/0165684 A1 Jun. 19, 2014

Related U.S. Application Data

(60) Provisional application No. 61/525,426, filed on Aug. 19, 2011.

(51) Int. Cl.

| | |
|---|---|
| ***B21D 26/02*** | (2011.01) |
| ***B21D 26/031*** | (2011.01) |
| ***B21D 26/025*** | (2011.01) |
| ***B21D 53/88*** | (2006.01) |

(52) U.S. Cl.
CPC ..... *B21D 26/031* (2013.01); *B21D 26/025* (2013.01); *B21D 53/88* (2013.01)
USPC ..... 72/60; 72/57; 72/370.22; 29/421.1

(58) Field of Classification Search
USPC ..... 72/56, 57, 58, 60, 61, 62, 370.22; 29/421.1
See application file for complete search history.

(56) References Cited

U.S. PATENT DOCUMENTS 1,766,098 A * 6/1930 Booth ..... 72/58
3,124,090 A * 3/1964 Zatyko ..... 72/58
(Continued)

FOREIGN PATENT DOCUMENTS

DE 102010015734 A1 11/2010
JP 2030331 A 1/1990
(Continued)

OTHER PUBLICATIONS

Nov. 13, 2012, International Search Report from Canadian Receiving Office, in PCT/CA2012/000774, which shares the same priority as this U.S. application.

*Primary Examiner* — David B Jones
(74) *Attorney, Agent, or Firm* — Kolisch Hartwell, P.C.

(57) ABSTRACT

A forming tool apparatus is provided for forming an article having a negative draft angle that locks the formed article within the forming tool. An insert, which is disposed within a recess defined in a forming surface of the forming tool, has a surface that cooperates with the forming surface of the forming tool to shape a metal blank into a desired final shape. In particular, the surface of the insert is shaped to define the negative draft angle feature of the formed article. Subsequent to forming the article, a linear-drive mechanism is activated to withdraw the insert away from the formed article, and thereby unlock the formed article from the tool. The formed article is then extracted from the tool along an extraction direction that is other than parallel to the direction along which the insert is driven.

18 Claims, 5 Drawing Sheets

(56) References Cited

U.S. PATENT DOCUMENTS

| | | | | |
|---|---|---|---|---|
| 3,592,034 | A * | 7/1971 | McMeen et al. | 72/58 |
| 3,820,369 | A * | 6/1974 | Tominaga | 72/55 |
| 5,097,689 | A * | 3/1992 | Pietrobon | 72/58 |
| 6,523,386 | B2 | 2/2003 | Matsuoka | |
| 6,820,317 | B2 * | 11/2004 | Okada | 29/421.1 |
| 6,966,209 | B1 | 11/2005 | Schulze | |
| 7,047,779 | B2 | 5/2006 | Kruger et al. | |
| 7,306,451 | B2 | 12/2007 | Kruger et al. | |
| 7,665,341 | B2 | 2/2010 | Kinoshita | |
| 2002/0121122 | A1 | 9/2002 | Matsuoka | |
| 2005/0150266 | A1 | 7/2005 | Kruger et al. | |
| 2007/0039370 | A1 | 2/2007 | Kruger et al. | |
| 2009/0113978 | A1 | 5/2009 | Kinoshita | |

FOREIGN PATENT DOCUMENTS

| | | | |
|---|---|---|---|
| JP | 8323420 | A | 12/1996 |
| KR | 101167042 | B1 | 7/2012 |

* cited by examiner

SELF-COMPENSATING RETRACTABLE INSERT FOR HIGH-TEMPERATURE FORMING TOOLS

CROSS-REFERENCE TO RELATED APPLICATIONS

This application is a national phase application of PCT/CA2012/000774, entitled "Self Compensating Retractable Insert for High-Temperature Forming Tools," which was filed on Aug. 17, 2012, which claims priority from U.S. Provisional Patent Application No. 61/525,426, entitled "Self Compensating Retractable Insert Design for Class A undercut panels and parts in high temperature tooling, including Super Plastic Forming," which was filed on Aug. 19, 2011, the entire contents for each which are incorporated herein by reference.

FIELD OF THE INVENTION

The invention relates generally to sheet metal components, and more particularly to a process and forming tool apparatus for the forming of a sheet article having an undercut or negative draft angle that locks the formed article within the forming tool.

BACKGROUND OF THE INVENTION

Automotive and non-automotive body panels etc. are commonly manufactured using hot-forming techniques, in which heated sheet-metal blanks are made to conform to the shape of a cavity that is formed between the surfaces of forming tools that are mounted in a press. Superplastic forming is a specific example of a hot-forming process for forming sheet metal articles. It works upon the principle of superplasticity, which means that a material can elongate beyond 100% of its original size under carefully controlled conditions. An advantage of the superplastic forming process is that large and complex articles can be formed in a single operation, thereby reducing the need to assemble together smaller components while at the same time achieving weight reduction. Further, the formed article has excellent precision and a fine surface finish.

Exterior body panels of automobiles, the so-called "Class A surfaces," provide styling and aesthetic qualities that are intended to appeal to prospective buyers of an automobile. In general, "Class A surfaces" can be regarded as any surface that has styling intent. It is therefore common to form exterior automotive body panels with curves and contours, which give the finished automobile a sleek and "sexy" appearance. In the increasingly competitive automotive industry, a consumer's first impression in a dealer showroom can make all the difference in a sale.

Normally, the design of shaped articles including automotive body panels is such that the forming tool that is used to form the article will have forming tool walls that extend at a positive draft angle, and thereby ensure ease of removal of the finished article from the forming tool. However, in some instances the desired shape of the finished article requires that the forming tool have a negative draft angle by undercutting a wall of the forming tool cavity. Unfortunately, in such instances the finished article is locked within the forming tool and cannot be removed. Of course, various solutions have been proposed for enabling the removal, from a tool, of formed articles having a negative draft angle.

In United States Patent Application Publication 2005/0150266 Kruger et al. disclose a forming tool system including a finish-form tool that advances and retracts in accordance with a curvilinear path. The finish-form tool is pivotably mounted about a fixed pivot axis, such that the finish-form tool may separate from the formed article in accordance with the negative draft angle. Unfortunately, the entire finish-form tool pivots about the fixed pivot axis and therefore the extent to which the finished article may be undercut is limited. In particular, a deeply undercut section necessitates movement of the finish-form tool along a curvilinear path having a large radius, which path may be obstructed by other portions of the finished article.

In U.S. Pat. No. 7,306,451 Kruger et al. disclose a forming tool apparatus for forming an article, including a first forming tool having a removable cavity wall segment with an undercut cavity wall. A pivot linkage normally establishes the removable wall segment in a forming position in which the undercut wall is poised for forming of the article. The pivot linkage selectively pivots the removable wall segment out of the forming position when the forming tools are opened, so that the undercut wall is pivotally lifted and releases the formed article for removal from the cavity. Unfortunately, this system is very complex and relies on a pivoting movement of the removable wall segment to unlock the formed article. This requires the pivoting of a very large and heavy portion of the tool, which is designed such that the removable wall segment encompasses the entire Class A region of the article, and which results in other issues relating to making the necessary electrical connections, wire flexing fatigue, etc. As a result, implementing this system tends to be cost prohibitive.

It would be beneficial to provide a process and forming tool apparatus that overcome at least some of the above-mentioned limitations and disadvantages of the prior art.

SUMMARY OF THE INVENTION

In accordance with an aspect of at least one embodiment of the instant invention, there is provided a forming tool apparatus for forming an article having a negative draft angle that locks the formed article within the forming tool, the forming tool apparatus comprising: a first forming tool and a second forming tool, the second forming tool being moveable relative to the first forming tool between a closed condition to define a forming tool cavity in which the article is formed from a sheet metal blank and an open condition for removal of the formed article from the forming tool cavity along an extraction direction, the first forming tool having a first forming surface for forming a first portion of the article that other than includes the negative draft angle, and the first forming surface having a recess defined therein; an insert disposed within the recess and having a second forming surface for forming a second portion of the article that includes the negative draft angle, the second forming surface having a perimeter that is dimensioned smaller than a perimeter of the recess, the insert being linearly moveable relative to the first forming tool along a drive direction and between a forming position in which the second forming surface cooperates with the first forming surface to form the article and an extraction position in which the second forming surface is spaced apart from the formed article; a linear-drive mechanism in communication with the insert for moving the insert between the forming position and the extraction position; and at least two pressure pad assemblies disposed between the insert and an interior surface of the recess, each one of the at least two pressure pad assemblies including a temperature compensating spacer element for biasing the insert along a direction that is normal to the drive direction, such that during operation of the forming tool within a predetermined temperature range a substantially gapless boundary is formed between the second forming surface and the first forming surface along a predetermined segment of the perimeter of the second forming surface, and such that a variable-sized gap is formed between the second forming surface and the first forming surface along other than the predetermined segment of the perimeter of the second forming surface.

In accordance with an aspect of at least one embodiment of the instant invention, there is provided a forming tool apparatus for forming an article having a negative draft angle that locks the formed article within the forming tool, the forming tool apparatus comprising: a first forming tool and a second forming tool, the second forming tool being moveable relative to the first forming tool between a closed condition to define a forming tool cavity in which the article is formed from a sheet metal blank and an open condition for removal of the formed article from the forming tool cavity, the first forming tool having a first forming surface with a recess defined therein; an insert disposed within the recess and having a second forming surface including a feature for forming the negative draft angle in the formed article, the insert being linearly moveable within the recess and relative to the first forming tool between a forming position in which the second forming surface cooperates with the first forming surface to form the article and an extraction position in which the feature for forming the negative draft angle is spaced apart from the formed article; at least two pressure pad assemblies disposed between the insert and an interior surface of the recess, each one of the at least two pressure pad assemblies including a temperature compensating spacer element for locating the insert within the recess such that when the insert is in the forming position the second forming surface and the first forming surface form a substantially gapless boundary therebetween within a predetermined area that corresponds to a Class A surface of the formed article, and such that outside of the predetermined area the second forming surface and the first forming surface are separated by a gap that varies during operation of the forming tool within a predetermined temperature range; and a linear-drive mechanism in communication with the insert for moving the insert between the forming position and the extraction position.

In accordance with an embodiment of the invention two pressure pad assemblies are provided.

In accordance with another embodiment of the invention three pressure pad assemblies are provided.

In accordance with an aspect of at least one embodiment of the instant invention, there is provided a process for forming an article from a sheet metal blank using a forming tool apparatus having opposing tools, one of said opposing tools comprising a first forming surface having a recess defined therein and an insert disposed within said recess, the insert having a second forming surface defining a negative draft angle feature of the formed article and being linearly moveable within the recess, along a drive direction, between a forming position and an extraction position, the method comprising: placing said sheet metal blank between said opposing tools; closing said opposing tools together to define a forming tool cavity, said first forming surface and said second forming surface facing toward said forming tool cavity and cooperating one with the other to define a final shape of the formed article including the negative draft angle feature; with the insert in the forming position, forming the sheet metal blank into the final shape of the formed article; moving said insert away from said formed article and to the extraction position of said insert; opening said opposing tools; and extracting said formed article along an extraction direction that is other than parallel to the drive direction.

BRIEF DESCRIPTION OF THE DRAWINGS

The instant invention will now be described by way of example only, and with reference to the attached drawings, wherein similar reference numerals denote similar elements throughout the several views, and in which.

DETAILED DESCRIPTION OF EMBODIMENTS OF THE INVENTION

The following description is presented to enable a person skilled in the art to make and use the invention, and is provided in the context of a particular application and its requirements. Various modifications to the disclosed embodiments will be readily apparent to those skilled in the art, and the general principles defined herein may be applied to other embodiments and applications without departing from the scope of the invention. Thus, the present invention is not intended to be limited to the embodiments disclosed, but is to be accorded the widest scope consistent with the principles and features disclosed herein.

Figure 1:
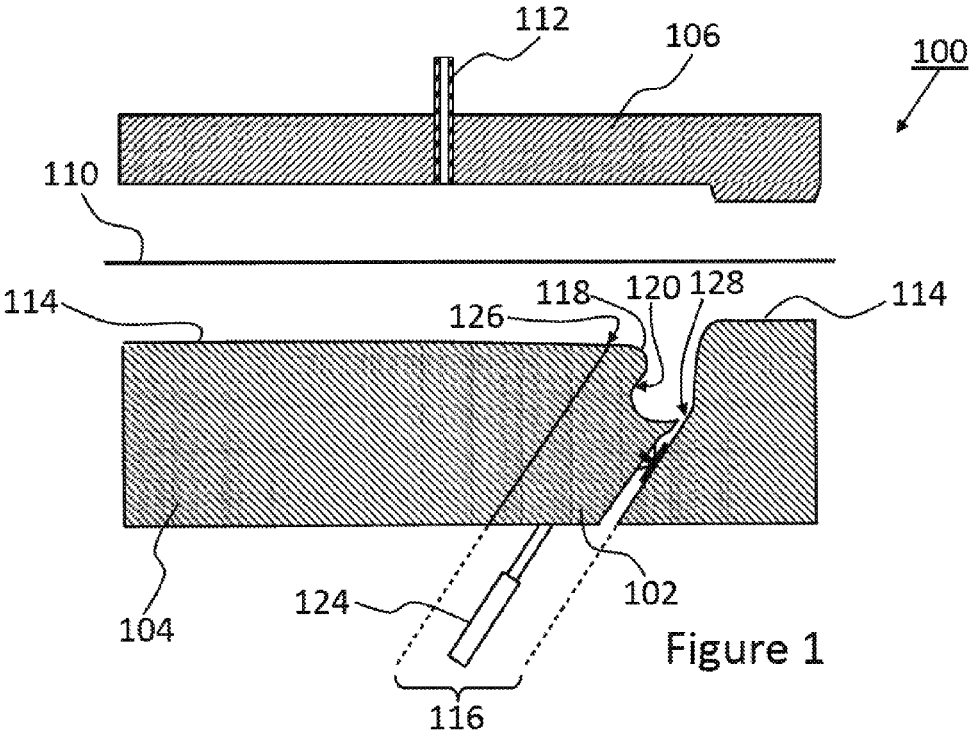
FIG. 1 is a simplified cross-sectional view taken through a forming tool apparatus according to an embodiment of the invention, the forming tool apparatus shown in an open condition and an insert shown in a forming position.
Figure 2:
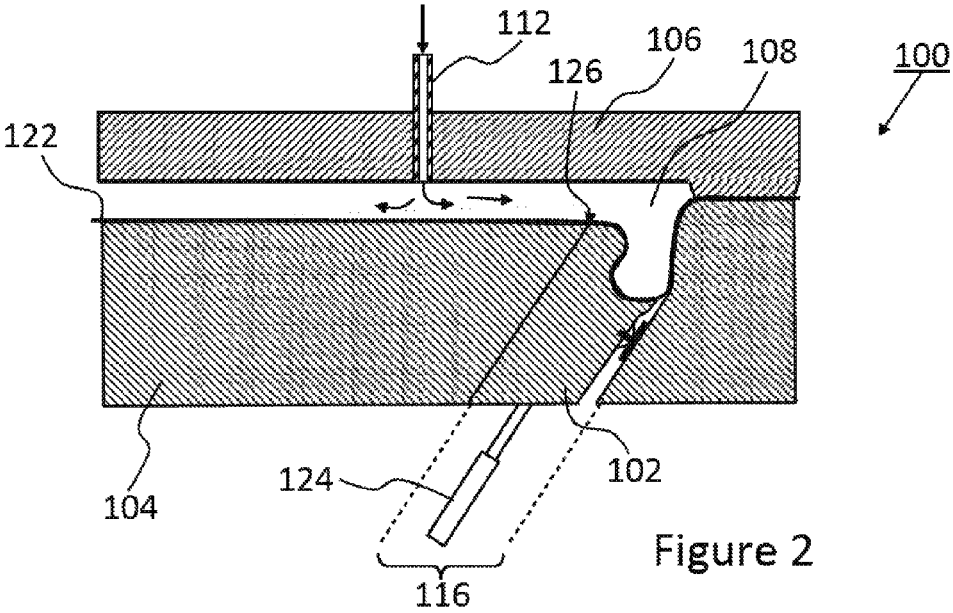
FIG. 2 is a simplified cross-sectional view taken through the forming tool apparatus of FIG. 1, the forming tool apparatus shown in a closed condition and the insert shown in the forming position.

Referring to FIGS. 1 and 2, shown are simplified cross-sectional views taken through a forming tool apparatus 100 according to an embodiment of the invention. In FIG. 1, the forming tool apparatus 100 is depicted in an open condition and with an insert 102 disposed in a forming position. In FIG. 2 the forming tool apparatus 100 is depicted in a closed condition and with the insert 102 disposed in the forming position. The forming tool apparatus 100 includes a lower forming tool 104 and an upper forming tool 106, the lower forming tool 104 and the upper forming tool 106 being moveable one relative to the other between the open condition that is shown in FIG. 1 and the closed condition that is shown in FIG. 2. When in the closed condition, the lower forming tool 104 and the upper forming tool 106 define a forming tool cavity 108. By way of a specific and non-limiting example, the forming tool apparatus 100 that is shown in FIGS. 1 and 2 is for the forming of a sheet of heated metal 110 by the superplastic forming process. Upper forming tool 106 has a gas inlet 112 through which a high pressure gas (indicated using arrows in FIG. 2) is introduced, after the upper forming tool 106 and lower forming tool 104 are moved together, to force the preheated sheet metal blank 110 into contact with the lower forming tool 104.

As will be apparent, certain parts of the forming tool apparatus that are not essential to gaining an understanding the invention have been omitted from the drawings in order to preserve clarity. In known fashion, the lower and upper forming tools 104 and 106 include not illustrated heating elements embedded therein to maintain the temperature of the preheated sheet metal blank 110 during forming. Further, the lower and upper forming tools 104 and 106 are mounted in a not illustrated press, such as for instance a hydraulic press or another conventional press known in the art, which moves the lower and upper forming tools 104 and 106 relative to one another between the open condition and the closed condition.

Figure 5:
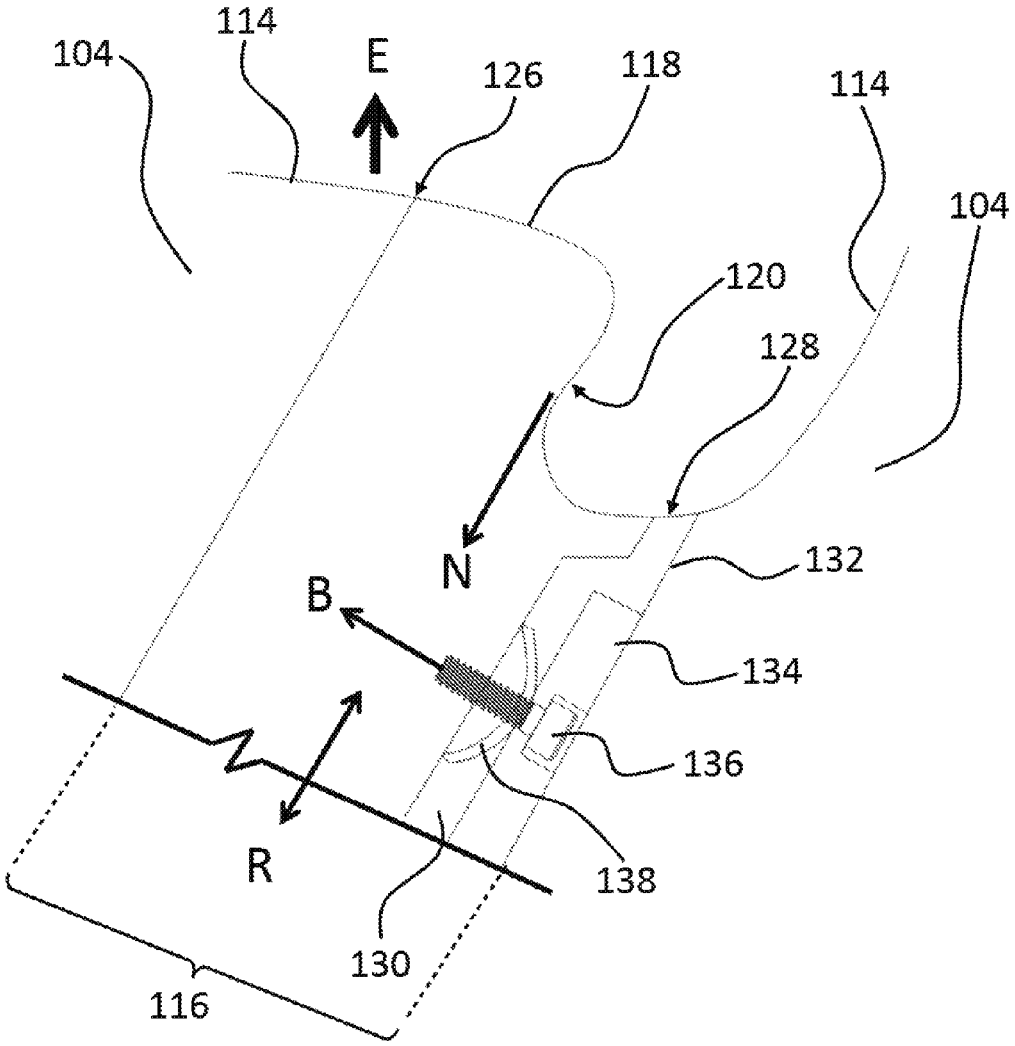
FIG. 5 is an enlarged view showing detail of the insert that is disposed within a recess defined within a forming surface of a lower forming tool of the forming tool apparatus.

As is further shown in FIG. 1, the lower forming tool 104 has a first forming surface 114, within which is defined a recess 116. In this specific example, the recess 116 is of substantially uniform cross-sectional shape and size between the opposite side of the lower forming tool 104. Disposed within the recess 116 is the insert 102, which has a second forming surface 118. In particular, the insert 102 is shown in the forming position in FIG. 1. Now referring also to FIG. 5, it is seen that the second forming surface 118 of the insert 102 includes a negative draft angle feature 120. During operation, the first forming surface 114 and the second forming surface 118 cooperate to form the heated sheet metal blank 110 into a finished article 122, which is then extracted from the forming tool apparatus 100 along the extraction direction E as shown in FIG. 5. However, it is to be understood that if the insert 102 remains in the forming position after the forming tool apparatus 100 is opened, then the negative draft angle feature 120 locks the finished article 122 (not illustrated in FIG. 5) into the forming tool apparatus 100.

Figure 3:
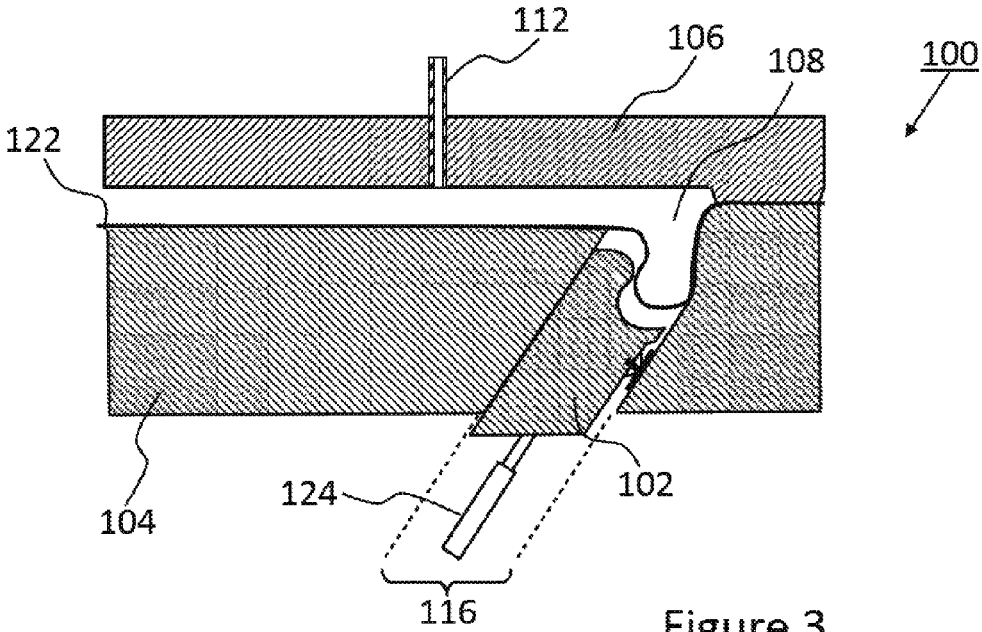
FIG. 3 is a simplified cross-sectional view taken through the forming tool apparatus of FIG. 1, the forming tool apparatus shown in the closed condition and the insert shown in an extraction position.
Figure 4:
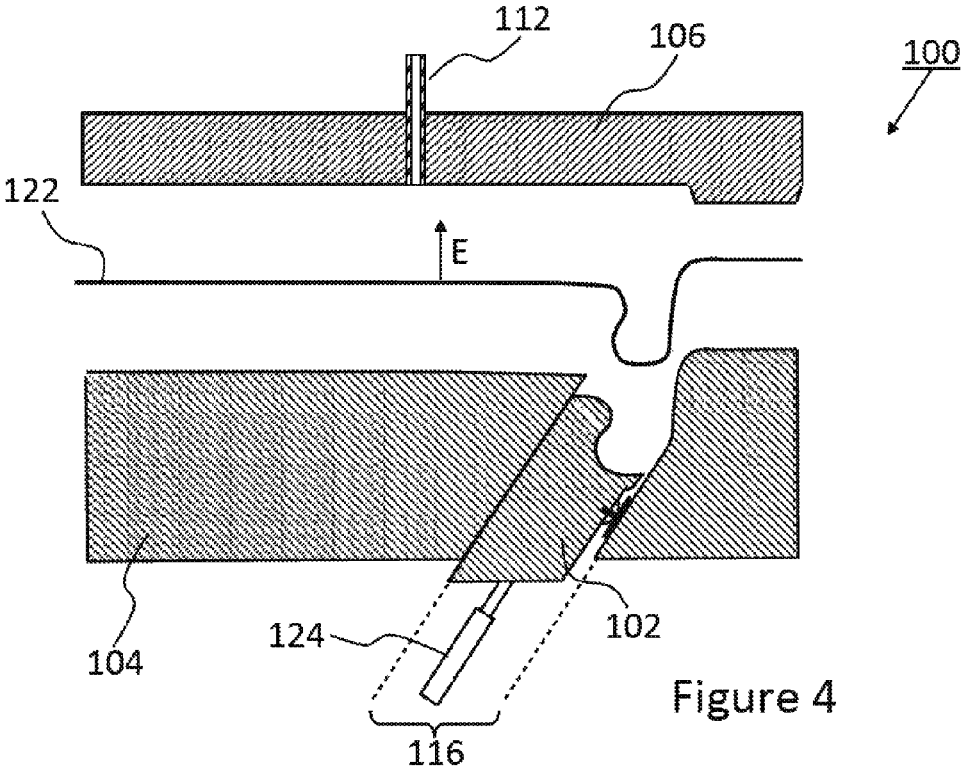
FIG. 4 is a simplified cross-sectional view taken through the forming tool apparatus of FIG. 1, the forming tool apparatus shown in the open condition and the insert shown in the extraction position.

Referring to FIG. 3, shown is a simplified cross-sectional view taken through the forming tool apparatus according to the current embodiment, the forming tool apparatus 100 being in the closed condition and the insert 102 being in an extraction position. A linear-drive mechanism 124, such as for instance one of a hydraulic actuator, a pneumatic actuator, a mechanical screw actuator, etc., is used to move the insert 102 along a direction R, as depicted in FIG. 5, which is away from the finished article 122 and substantially parallel to the negative draft angle N. Referring also to FIG. 4, when the forming tool apparatus 100 is in the opened condition and the insert 102 is in the extraction position as illustrated, the second forming surface 118 does not lock the finished article 122 into the forming tool apparatus 100, thereby allowing the finished article 122 to be removed along the extraction direction E.

Referring now to FIG. 5, the structure of the insert 102 is described in greater detail. In the specific embodiment disclosed in this document the forming tool apparatus 100 is used in a hot-forming process, such as for instance superplastic forming, to produce Class A panels for automotive and non-automotive applications. Class A panels must have excellent surface finish properties, since any blemishes or imperfections that are present on the Class A panels will be readily apparent to consumers. Further, the Class A panels are painted in subsequent steps, which tends to emphasize the presence of such blemishes or imperfections. It is therefore necessary to ensure a substantially gapless boundary 126 between the first forming surface 114 and the second forming surface 118 when the insert 102 is in the forming position as illustrated in FIGS. 1, 2 and 5. Such a substantially gapless boundary is achieved when the insert 102 is provided in slide-fit contact with an interior surface of the recess 116. The boundary 126 shown in FIGS. 1 and 5 is suitable for forming Class A panels, and is hereinafter referred to as a "Class A boundary."

Unfortunately, since the forming tool apparatus 100 is used in hot forming processes, such as for instance the superplastic forming process, both the lower forming tool 104 and the insert 102 are subject to thermal expansion and thermal contraction during operation of the forming tool apparatus within a predetermined temperature range. As a result, the insert 102 cannot be dimensioned to provide a slide-fit contact all the way around the interior surface of the recess 116, since the insert 102 would seize within the recess 116 as the temperature of the forming tool apparatus 100 is changed. Under such conditions, it would not be possible to move the insert 102 between the forming position and the extraction position. For this reason, non-Class A boundaries 128 are also provided between the insert 102 and the lower forming tool 104. In particular, non-Class A boundaries 128 result at locations where the insert 102 is not in slide-fit contact with the interior surface of the recess 116. By way of a specific and non-limiting example, a gap width of about 2-3 mm exists between the first forming surface 114 and the second forming surface 118 along non-Class A boundaries 128. Critically, the non-Class A boundaries 128 are located outside of a region of the forming surfaces that is used to form the Class A panels. In other words, the non-Class A boundaries 128 occur within portions of the forming surfaces that are e.g., adjacent to a region that will be trimmed away from the finished article 122, or adjacent to portions of the finished article 122 that will not be visible to the consumer, etc.

Referring still to FIG. 5, a space 130 between the insert 102 and an interior surface 132 of the recess 116 accommodates a pressure pad assembly. The pressure pad assembly includes a wear pad 134 that is mechanically coupled to the insert 102, such as for instance using bolt 136. The pressure pad assembly further includes a temperature compensating spacer element 138, such as for instance a Bellville spring washer, also known as a conical spring washer, which is fabricated from a suitable austenitic nickel-chromium-based superalloy, commonly referred to as an Inconel® alloy. Inconel® alloys are oxidation and corrosion resistant materials that are well suited for service in extreme environments subjected to pressure and heat. Optionally, the Belleville spring washer is fabricated from another suitable alloy. Optionally, a standard compression washer is used in place of a Belleville spring washer.

The temperature compensating spacer element 138 normally biases the insert 102 along a direction B, which is normal to the direction R along which the insert 102 moves between the forming position and the extraction position. As is shown most clearly in FIG. 5, the insert 102 is in slide-fit contact with the inner surface of the recess along the Class A boundary 126 and the wear pad 134 is in slide-fit contact with the inner surface 132 of the recess 116 along non-Class A boundary 128. As the temperature of the forming tool apparatus 100 varies during use, and the lower forming tool 104 and the insert 102 undergo thermal expansion and contraction, the temperature compensating spacer element 138 maintains the slide-fit contact between the insert 102 and the inner surface of the recess along the Class A boundary 126 and also maintains the slide-fit contact between the wear pad 134 and the inner surface 132 of the recess 116 along the non-Class A boundary 128.

Figure 6:
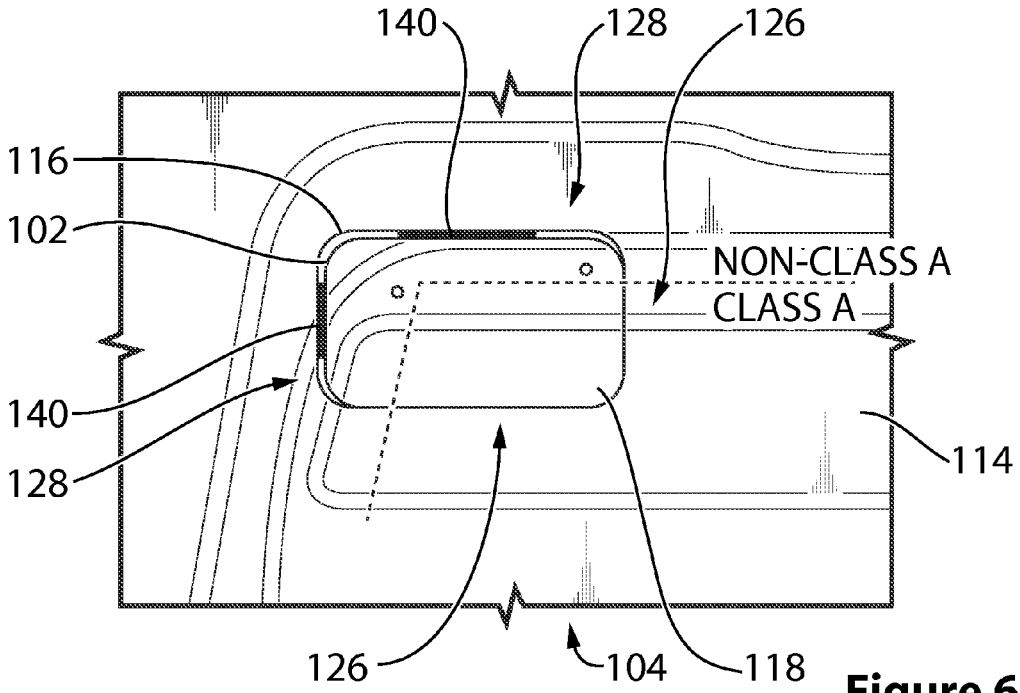
FIG. 6 is a simplified plan view showing a representative location of the insert of FIG. 5 within the forming surface of the lower forming tool, including two pressure pad assemblies and two Class A boundaries.

Referring now to FIG. 6, shown is a simplified plan view illustrating a representative location of the insert 102 within the first forming surface 114 of the lower forming tool 104. In the specific and non-limiting example that is shown in FIG. 6, two Class A boundaries 126 are formed between the first forming surface 114 of the lower forming tool 104 and the second forming surface 118 of the insert 102. On each side of the insert 102 opposite one of the Class A boundaries 126, a non-Class A boundary 128 is formed. In particular, a gap between the first forming surface 114 and the second forming surface 118 is visible in FIG. 6 along each of the non-Class A boundaries 128. A pressure pad assembly, shown generally at 140 in FIG. 6, is visible within the gap along each of the non-Class A boundaries 128. As described previously with reference to FIG. 5 each pressure pad assembly 140 includes a wear pad 134 that is mechanically coupled to insert 102, such as for instance using a bolt 136, and a temperature compensating spacer element 138. The Class A boundaries 126 are located within a region of the forming tool that forms the Class A panels. On the other hand, the non-class A boundaries 128 are located outside the region of the forming tool that forms the Class A panels. For clarity, the above-mentioned regions of the forming tool are delineated using the dashed line in FIG. 6.

Figure 7:
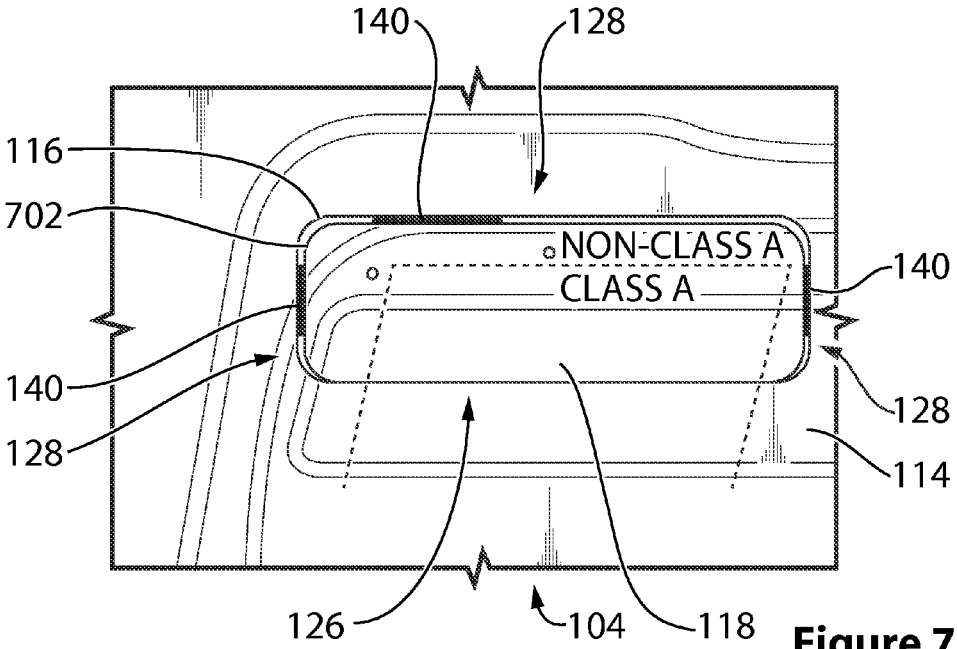
FIG. 7 is a simplified plan view showing a representative location of another insert within the forming surface of the lower forming tool, including three pressure pad assemblies and one Class A boundary.

Of course, FIG. 6 shows a specific and non-limiting example in which two pressure pad assemblies 140 are provided and two Class A boundaries 126 are formed between the first forming surface 114 and the second forming surface 118. Optionally, as shown in FIG. 7 three pressure pad assemblies 140 are provided and one Class A boundary 126 is formed. In this case, an insert 702 extends beyond opposite ends of the Class A portion of a formed article with a negative draft angle or undercut feature. As such, one Class A boundary 126 is formed between the first forming surface 114 of the lower forming tool 104 and the second forming surface 118 of the insert 702. On each side of the insert 702 other than along the Class A boundary 126, a non-Class A boundary 128 is formed. In particular, a gap between the first forming surface 114 and the second forming surface 118 is visible in FIG. 7 along each of the non-Class A boundaries 128. A pressure pad assembly, shown generally at 140 in FIG. 7, is visible within the gap along each of the non-Class A boundaries 128. Each pressure pad assembly 140 includes a wear pad 134 that is mechanically coupled to insert 702, such as for instance using a bolt 136, and a temperature compensating spacer element 138. The Class A boundary 126 is located within a region of the forming tool that forms the Class A panels. On the other hand, the non-class A boundaries 128 are located outside the region of the forming tool that forms the Class A panels. For clarity, the above-mentioned regions of the forming tool are delineated using the dashed line in FIG. 7.

In the specific and non-limiting examples that are shown in the drawings, the inserts 102 and 702 are generally rectangular in shape with four rounded corners. Alternatively the inserts 102 and 702 have a different shape and/or a different number of rounded corners.

Of course, the tool forming apparatus and process as described herein is also suitable for forming articles made from sheet metal using warm forming or hot forming operations other than the superplastic forming process.

While the above description constitutes a plurality of embodiments of the present invention, it will be appreciated that the present invention is susceptible to further modification and change without departing from the fair meaning of the accompanying claims.

What is claimed is:

1. A forming tool apparatus for forming an article having a negative draft angle that locks the formed article within the forming tool, the forming tool apparatus comprising:

a first forming tool and a second forming tool, the second forming tool being moveable relative to the first forming tool between a closed condition to define a forming tool cavity in which the article is formed from a sheet metal blank and an open condition for removal of the formed article from the forming tool cavity along an extraction direction, the first forming tool having a first forming surface for forming a first portion of the article that other than includes the negative draft angle, and the first forming surface having a recess defined therein;

an insert disposed within the recess and having a second forming surface for forming a second portion of the article that includes the negative draft angle, the second forming surface having a perimeter that is dimensioned smaller than a perimeter of the recess, the insert being linearly moveable relative to the first forming tool along a drive direction and between a forming position in which the second forming surface cooperates with the first forming surface to form the article and an extraction position in which the second forming surface is spaced apart from the formed article;

a linear-drive mechanism in communication with the insert for moving the insert between the forming position and the extraction position; and at least two pressure pad assemblies disposed between the insert and an interior surface of the recess, each one of the at least two pressure pad assemblies including a temperature compensating spacer element for biasing the insert along a direction that is normal to the drive direction, such that during operation of the forming tool within a predetermined temperature range a substantially gapless boundary is formed between the second forming surface and the first forming surface along a predetermined segment of the perimeter of the second forming surface, and such that a variable-sized gap is formed between the second forming surface and the first forming surface along other than the predetermined segment of the perimeter of the second forming surface.

2. The forming tool apparatus according to claim 1 wherein each one of the at least two pressure pad assemblies comprises a wear pad that is mechanically coupled to the insert, the wear pad being in slide-fit contact with the interior surface of the recess.

3. The forming tool apparatus according to claim 2 wherein each one of the at least two pressure pad assemblies comprises a bolt coupling together the wear pad and the insert, and wherein the temperature compensating spacer element is a conical spring washer mounted onto the bolt.

4. The forming tool apparatus according to claim 3 wherein the conical spring washer is fabricated from an austenitic nickel-chromium-based superalloy.

5. The forming tool apparatus according to claim 1 wherein the linear-drive mechanism comprises one of a hydraulic actuator, a pneumatic actuator and a mechanical screw actuator.

6. The forming tool apparatus according to claim 1 wherein the first forming tool and the second forming tool each include heating elements for controllably heating the forming tool apparatus within a predetermined temperature range.

7. The forming tool apparatus according to claim 1 wherein the at least two pressure pad assemblies consists of two pressure pad assemblies.

8. The forming tool apparatus according to claim 1 wherein the at least two pressure pad assemblies consists of three pressure pad assemblies.

9. The forming tool apparatus according to claim 1 wherein the drive direction of the insert is other than parallel to the extraction direction of the formed article.

10. A forming tool apparatus for forming an article having a negative draft angle that locks the formed article within the forming tool, the forming tool apparatus comprising:

a first forming tool and a second forming tool, the second forming tool being moveable relative to the first forming tool between a closed condition to define a forming tool cavity in which the article is formed from a sheet metal blank and an open condition for removal of the formed article from the forming tool cavity, the first forming tool having a first forming surface with a recess defined therein;

an insert disposed within the recess and having a second forming surface including a feature for forming the negative draft angle in the formed article, the insert being linearly moveable within the recess and relative to the first forming tool between a forming position in which the second forming surface cooperates with the first forming surface to form the article and an extraction position in which the feature for forming the negative draft angle is spaced apart from the formed article;

at least two pressure pad assemblies disposed between the insert and an interior surface of the recess, each one of the at least two pressure pad assemblies including a temperature compensating spacer element for locating the insert within the recess such that when the insert is in the forming position the second forming surface and the first forming surface form a substantially gapless boundary therebetween within a predetermined area that corresponds to a Class A surface of the formed article, and such that outside of the predetermined area the second forming surface and the first forming surface are separated by a gap that varies during operation of the forming tool within a predetermined temperature range; and a linear-drive mechanism in communication with the insert for moving the insert between the forming position and the extraction position.

11. The forming tool apparatus according to claim 10 wherein each one of the at least two pressure pad assemblies comprises a wear pad that is mechanically coupled to the insert, the wear pad being in slide-fit contact with the interior surface of the recess.

12. The forming tool apparatus according to claim 11 wherein each one of the at least two pressure pad assembly comprises a bolt coupling together the wear pad and the insert, and wherein the temperature compensating spacer element is a conical spring washer mounted onto the bolt.

13. The forming tool apparatus according to claim 12 wherein the conical spring washer is fabricated from an austenitic nickel-chromium-based superalloy.

14. The forming tool apparatus according to claim 10 wherein the linear-drive mechanism comprises one of a hydraulic actuator, a pneumatic actuator and a mechanical screw actuator.

15. The forming tool apparatus according to claim 10 wherein the first forming tool and the second forming tool each include heating elements for controllably heating the forming tool apparatus within the predetermined temperature range.

16. The forming tool apparatus according to claim 10 wherein the at least two pressure pad assemblies consists of two pressure pad assembly.

17. The forming tool apparatus according to claim 10 wherein the at least two pressure pad assembly consists of three pressure pad assemblies.

18. The forming tool apparatus according to claim 10 wherein the formed article is extracted along an extraction direction, and wherein the insert is moved along a drive direction between the forming position and the extraction position, the drive direction being other than parallel to the extraction direction of the formed article.

* * * * *